US007861979B2

(12) United States Patent
Beaman

(10) Patent No.: US 7,861,979 B2
(45) Date of Patent: Jan. 4, 2011

(54) DRAGGING EQUIPMENT DETECTOR

(76) Inventor: Donald Coy Beaman, 4451 FM 147, Thornton, TX (US) 76687

( * ) Notice: Subject to any disclaimer, the term of this patent is extended or adjusted under 35 U.S.C. 154(b) by 331 days.

(21) Appl. No.: 11/985,168

(22) Filed: Nov. 14, 2007

(65) Prior Publication Data

US 2009/0057495 A1 Mar. 5, 2009

Related U.S. Application Data

(60) Provisional application No. 60/967,071, filed on Aug. 31, 2007.

(51) Int. Cl.
*B61K 1/00* (2006.01)

(52) U.S. Cl. ..... 246/169 R; 246/246; 246/249

(58) Field of Classification Search ..... 246/169 R; 340/686.1, 686.6; 73/12.09; 12/14
See application file for complete search history.

(56) References Cited

U.S. PATENT DOCUMENTS 2,435,365 A * 2/1948 Post ..... 246/169 R
2,662,973 A * 12/1953 McGowan et al. ..... 246/246
2,691,722 A * 10/1954 Lewis ..... 246/246
2,848,602 A * 8/1958 Post ..... 246/246
2,993,988 A * 7/1961 Post et al. ..... 246/169 R
3,325,640 A * 6/1967 Gieskieng ..... 246/246
3,538,272 A * 11/1970 Sibley ..... 200/61.41
3,546,448 A * 12/1970 Pelino ..... 246/246
3,558,875 A * 1/1971 Gieskieng ..... 246/169 R
7,292,144 B2 * 11/2007 Ballinger ..... 340/540
2006/0076461 A1 * 4/2006 DeRose et al. ..... 246/122 R
2007/0152107 A1 * 7/2007 LeFebvre et al. ..... 246/169 R
2009/0057495 A1 * 3/2009 Beaman ..... 246/1 C

* cited by examiner

*Primary Examiner*—Mark T Le
*Assistant Examiner*—Jason C Smith
(74) *Attorney, Agent, or Firm*—Thrasher Associates

(57) ABSTRACT

Disclosed systems, methods, and apparatti generally define inventions that detect and alert train crews of a potentially unsafe condition caused by equipment hanging below any portion of the train. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

2 Claims, 3 Drawing Sheets

DRAGGING EQUIPMENT DETECTOR

CROSS-REFERENCE TO RELATED APPLICATION

The invention is related to and claims priority from U.S. Provisional Patent Application No. 60/967,071 to Beaman, entitled DRAGGING EQUIPMENT DETECTOR filed on 31 Aug. 2007.

TECHNICAL FIELD OF THE INVENTION

The present invention relates generally to railroads.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

Objects hanging below or off the side of a train can cause serious problems for railroads, including derailment, injury, or death. Therefore, there exists the need for systems and devices that have the ability to detect objects hanging from a train, and no such devices are known to exist to the inventors, outside those items discussed herein, and the present disclosure.

BRIEF DESCRIPTION OF THE DRAWINGS

Various aspects of the invention, as well as an embodiment, are better understood by reference to the following detailed description. To better understand the invention, the detailed description should be read in conjunction with the drawings, in which like numerals represent like elements unless otherwise stated.

EXEMPLARY EMBODIMENT OF A BEST MODE

Interpretation Considerations

Figure 1:
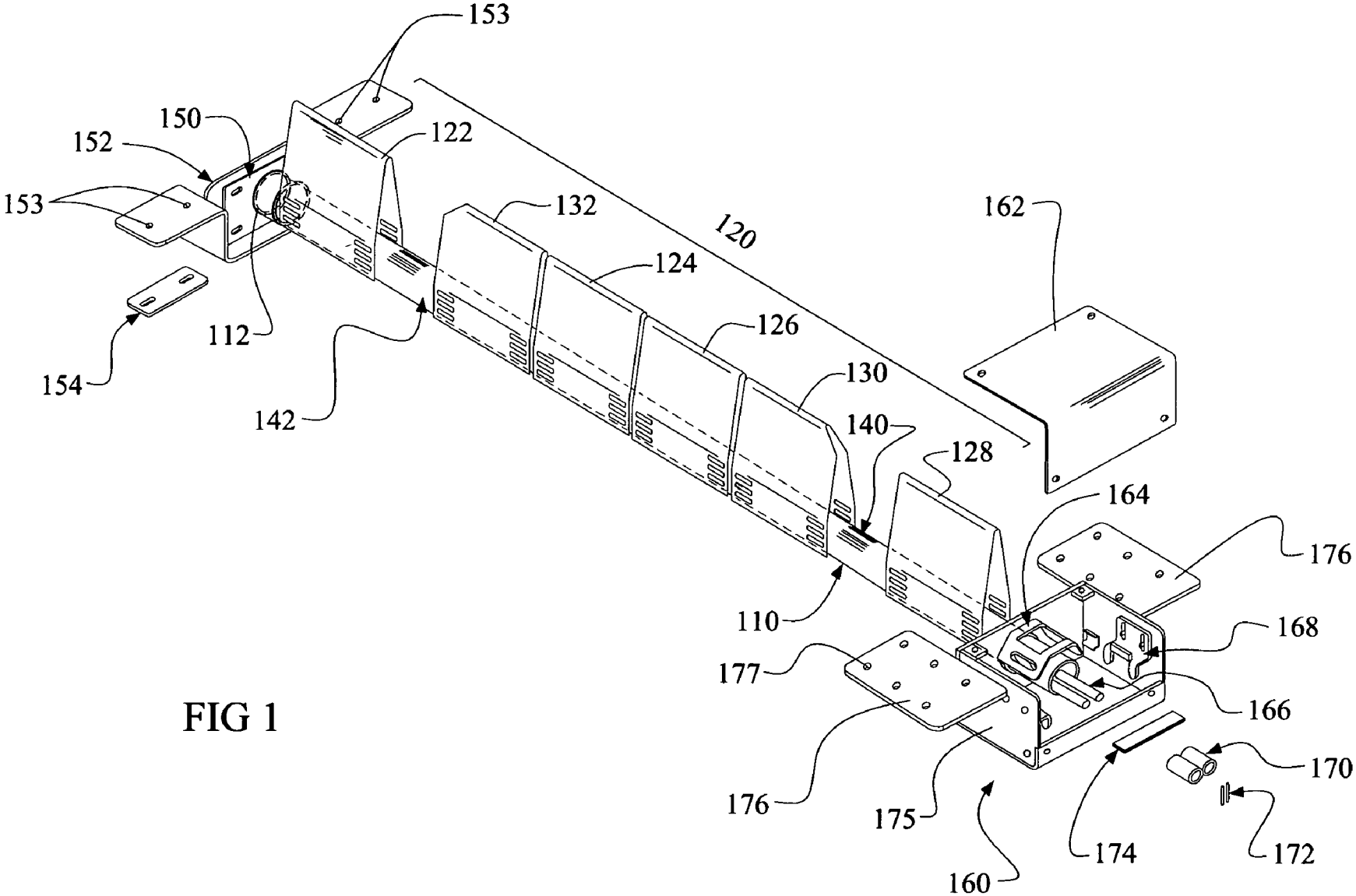
FIG. 1 shows an exemplary dragging equipment detector (DED).

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for —functioning—" or "step for —functioning—" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise.

Some methods of the invention may be practiced by placing the invention on a computer-readable medium and/or in a data storage ("data store") either locally or on a remote computing platform, such as an application service provider, for example. Computer-readable mediums include passive data storage, such as a random access memory (RAM) as well as semi-permanent data storage such as a compact disk read only memory (CD-ROM). In addition, the invention may be embodied in the RAM of a computer and effectively transform a standard computer into a new specific computing machine.

Data elements are organizations of data. One data element could be a simple electric signal placed on a data cable. One common and more sophisticated data element is called a packet. Other data elements could include packets with additional headers/footers/flags. Data signals comprise data, and are carried across transmission mediums and store and transport various data structures, and, thus, may be used to transport the invention. It should be noted in the following discussion that acts with like names are performed in like manners, unless otherwise stated.

Of course, the foregoing discussions and definitions are provided for clarification purposes and are not limiting. Words and phrases are to be given their ordinary plain meaning unless indicated otherwise.

DESCRIPTION OF THE DRAWINGS

FIG. 1 shows a dragging equipment detector (DED) according to the teachings of the invention. Functionally, DED generally comprises striker paddles 120 that are rigidly affixed to a striker shaft 110. The striker shaft 110 rotates when a paddle 120 is struck by an item hanging from a train. This rotation is detected by sensors and the crew of the train is then notified of the condition.

Figure 3:
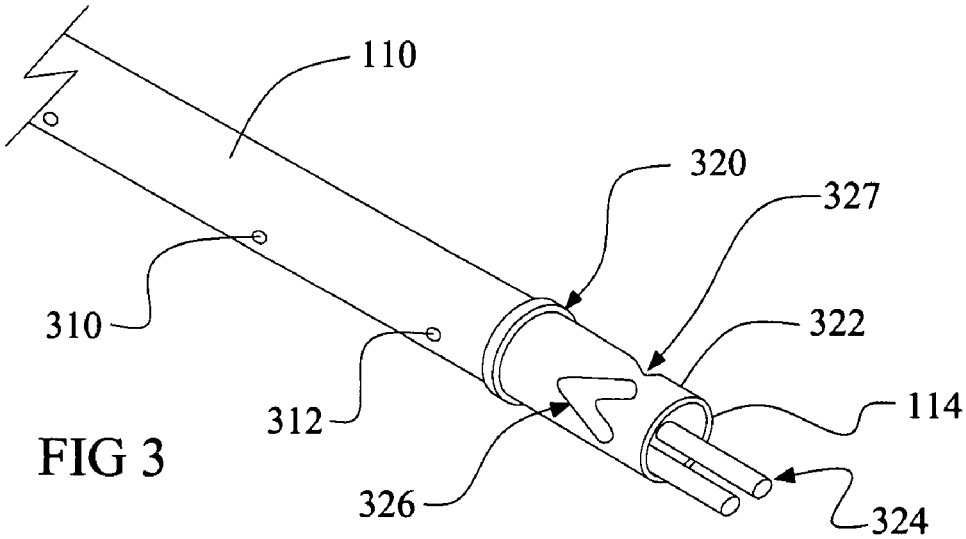
FIG. 3 is a close-up of an exemplary shaft spring and sensor end.

The dragging equipment detector's rotatable striker shaft 110 has a length defined between a support mount end 112 and a spring mount end 114 (see FIG. 3). A plurality of striker paddles 120 are coupled to the striker shaft 110 such that when in operation (ie, when the DED is in place on a railroad track), each paddle maintains a generally vertical position when the spring (discussed later) is at rest.

Figure 2A:
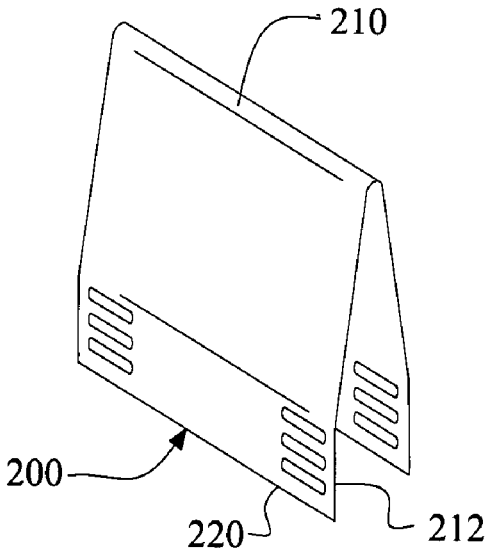
FIG. 2*a* is an exemplary striker paddle.

There are two types of striker paddles employed in the present embodiment. FIG. 2*a* is a standard striker paddle 200 ("striker paddle 200"). The striker paddle 200 is preferably about a foot wide, and about a foot high from its base 220 to its top 210, which is preferably a fold-over of a single piece of high-gauge steel. The actual height of any striker paddle relative to the striker shaft 110 may be adjusted via a plurality of mounting slots 212 which are preferably situated in two columns, one along each edge of the front of the striker paddle 200 and in two columns, one along each edge of the back of the striker paddle 200. Accordingly, each striker paddle may be raised or lowered in height simply by choosing the mounting 212 and then bolting (or otherwise attaching) the paddle to the striker shaft 110, thus making each paddle height-adjustable.

Figure 2B:
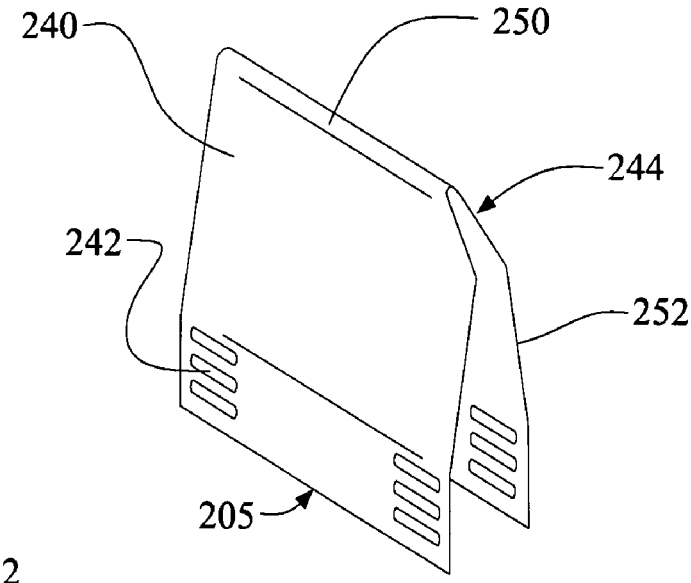
FIG. 2*b* is an exemplary interior rail-striker paddle.

FIG. 2*b* is an interior rail-striker paddle 205 which is designed to accommodate the area just inside each rail of a railroad track. The interior-rail striker paddle is preferably slightly wider than the striker paddle 200, such as about an inch wider. Like the striker paddle 200, the interior-rail striker paddle 205 is about a foot high from its base 220 to its top 210, is preferably a fold-over of a single piece of high-gauge steel, and includes a plurality of height-adjusting mounting slots 242. Additionally, the interior rail-striker paddle 205 includes a train-wheel clearance notch 244. Functionally, the notch 244 accommodates the space needed for a train wheel to pass the paddle without hitting it. In the preferred embodiment shown, the notch is a generally 45-degree angle cut which terminates at the top 250 approximately one-inch from the notched edge 252, and terminates along the notched edge 252 approximately one-inch from the top 250.

The striker shaft 110 is rotatably coupled to a support mount (collectively 150-153, and discussed in more detail in FIG. 3) at the support mount end 112 such that the striker shaft 110 is axially rotatable. Additionally, the striker shaft 110 is rotatably coupled to a preferably composite fiber leaf spring (discussed later) at the spring mount end 114. Furthermore, the striker shaft 110 is coupled to a sensor at either the spring mount end 114 or the support shaft end 112.

Accordingly, when the striker paddles 120 are coupled to the striker shaft 110, a first gap 140 is formed between a first striker paddle 128 and a second striker paddle 130, and a second gap 142 is formed between a third striker paddle 122 and a fourth striker paddle 132, where each gap 140, 142 is sufficiently wide to accommodate the width of a single rail of a train track. Preferably, as shown in FIG. 1, the second striker paddle 130 and the fourth striker paddle 132 are interior rail-striker paddles. Furthermore, two additional striker paddles—a fifth striker paddle 124 and a sixth striker paddle 126 are shown mounted proximate to a center-portion of the striker shaft 110.

FIG. 3 is a close-up of a shaft spring and sensor end 114. Although the features of a spring and a sensor are shown proximately in FIG. 3, it should be understood that equivalent functionality is achievable by separating these functions, and it is not intended to be implied that both features must be present in the same end portion of the striker shaft to fall within the teachings of the invention. Further, a sensor may be located proximate to either the spring and sensor end 114 or the support shaft end 112 of the striker shaft 110.

The striker shaft 110 includes mounting holes 310, 312 which are spaced to accommodate the slots of the striker paddles 120 (ie, about a foot apart), and are preferably threaded. Although not shown, there are preferably two additional holes on the opposite side of the striker shaft 110, each situated approximately opposite of the mounting holes 310, 312 shown. A shaft collar 320 around the circumference of the striker shaft 110 is positioned to sit inside the housing, as discussed below in the description of FIG. 5. The striker shaft 110 has a tapered portion 322 defined from the shaft collar 320 to the end of the spring end 114 of the striker shaft 110. Within the tapered portion 322 is a first sensor cut-out 326 and a corresponding second sensor cut-out 327. The sensor cut-outs 326, 327 are preferably V-shaped cut-outs which trigger proximity sensors as discussed below in FIG. 5. Further, the striker shaft 110 preferably includes at the spring end 114 two roller pins 324 which engage and activate a spring-loaded means, which is also discussed in greater detail in FIG. 5. The roller pins 324 are designed to occupy a generally horizontal plane when at rest, and are strong enough and secured to the striker shaft 110 rigidly enough to survive the tremendous forces encountered when a piece of train debris strikes a paddle and transfers such forces to the roller pins 324. Upon reading this disclosure, one of ordinary skill in the art is able to determine the material, length, and nature of the roller pins 324.

Figure 4:
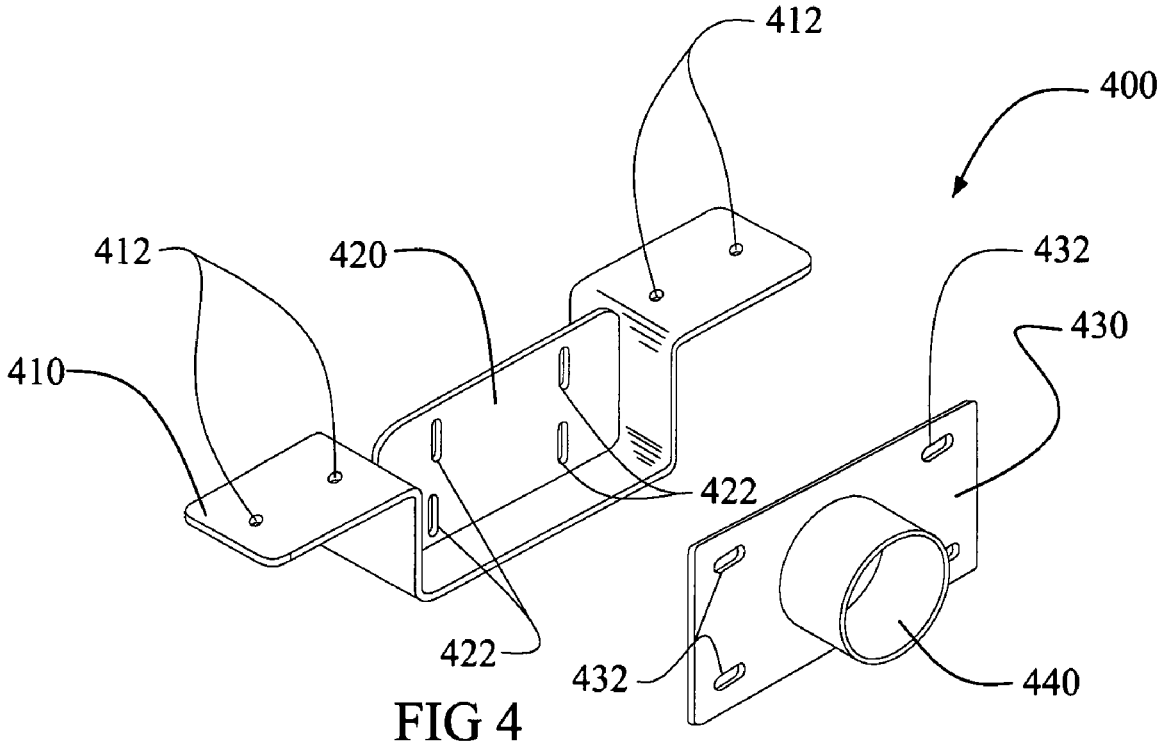
FIG. 4 shows an exemplary shaft support assembly.

FIG. 4 shows a shaft support assembly (support mount) 400. The support shaft assembly 400 is, upon reading this disclosure, a device that is readily recognizable to those of ordinary skill in the mechanical arts. In particular, the support shaft assembly 400 comprises a support 410 having a plurality of holes 412 (labeled 153 in FIG. 1) therein. The holes 412 allow the support shaft assembly 400 to be secured to railroad ties (not shown) via screws, nuts and bolts, and other means known in the mechanical arts, which may include backup plates 154 which are coupled to the shaft support via the holes 412. The support mount 400 includes a bushing 440 in which the striker shaft 110 is rotatably coupled. The bushing 440 is rigidly coupled to a bushing plate 430 (150 in FIG. 1) which has a plurality of mounting plate holes 432. The mounting plate holes 432 mate with holes 422 in the shaft support mount 420 (152 in FIG. 1) via nut-and-bolt or other means to secure the bushing mounting plate 430 to the shaft support mount 420. As shown in FIG. 4, the shaft support mount 420 is secured to the support plate 410 via welding or other secure means.

Figure 5:
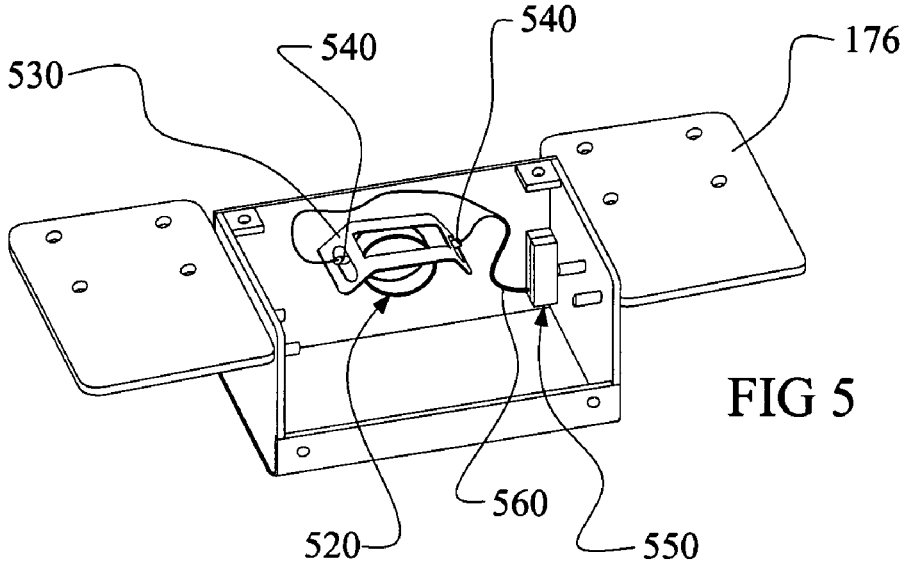
FIG. 5 illustrates an exemplary spring and sensor housing.

FIG. 5 in combination with FIG. 1 illustrate a spring and sensor housing 160. It should be understood that the spring and sensor are not necessarily co-located, however, at the time of filing this patent application the best mode of the invention is to co-locate the spring and sensor into a single housing. When not co-located, the housing may be referred to as the spring housing when it maintains a spring or a sensor housing when it maintains at least one sensor. The spring and sensor housing 160 includes a housing box 175 which is attached to a pair of mounting plates 176. The mounting plates 176 have holes 177 through which spikes, screws, or bolts may be used to mount the DED to a railroad tie. The box 176 also includes a shaft bushing 520, which as seen from FIG. 1, is rotatably coupled to the striker shaft 110. A housing cover 162, which is preferably steel, attaches to the box 175 to environmentally isolate the parts therein.

The spring and sensor housing 160 generally comprises a spring system and a sensor system. The spring system comprises a pair of spring rollers 170 which are mounted on the roller pins 324 (shown as 166 in FIG. 1) and held in place by cotter pins 172. The interior of the box (also known as a housing interior) 175 has a pair of opposingly placed spring retainers 168 which are used to mount a composite spring 174 inside the box in a manner that is readily apparent to those of skill in the mechanical arts upon reading this disclosure. In particular, the composite spring 174 is rigidly mounted so that when the spring 174 is at rest, the striker shaft 110 is oriented such that the striker paddles 120 are in a generally vertical position; further, the composite spring 174 is rigidly mounted such that when at least one striker paddle 120 not in a generally vertical position the striker shaft 110 rotates and the roller shaft 110 and the spring rollers 170 cause the composite spring 174 to hold a force that tends to want to return the paddles 120 to the vertical position. Of course, it is understood that the spring system shown in FIG. 1 can be interchanged with any number of other alternative spring systems known to those of skill in the art.

The sensor system comprises a pair of proximity sensors 540 mounted on a sensor bracket 530 so that they are located adjacent to the sensor cut-out 326. The proximity sensors 540 are coupled to a terminal block 550 via wires 560. Accordingly, the sensors 540 are able to detect a change in a rotational position of the striker shaft 110. Preferably, the proximity sensors have a wireless transmitter for wireless communication with a train or central facility.

Though the invention has been described with respect to a specific preferred embodiment, many variations and modifications (including equivalents) will become apparent to those skilled in the art upon reading the present application. It is therefore the intention that the appended claims and their equivalents be interpreted as broadly as possible in view of the prior art to include all such variations and modifications.

I claim:

1. A dragging equipment detector, comprising:

a rotatable striker shaft of a length defined between a support mount end and a composite leaf spring mount end;

the striker shaft having a plurality of striker paddles coupled thereto;

each paddle coupled to the striker shaft such that when in operation each paddle maintains a generally vertical position when at rest;

the striker shaft rotateably coupled to a support mount at the support mount end such that the striker shaft is axially rotatable;

the striker shaft rotateably coupled to a composite Leaf spring at the spring mount end; and the striker shaft coupled to a sensor at either the spring mount end or the support shaft end;

wherein the composite leaf spring comprises:

a pair of spring rollers mounted to spring retainers, the spring retainers extend from the spring end of the striker shaft;

a composite spring rigidly mounted so that when the spring is at rest, the striker shaft is rotated such that the striker paddles are in a generally vertical position; and the composite leaf spring rigidly mounted such that when at least one striker paddle not in the generally vertical position the striker shaft rotates and the roller shafts and the spring rollers cause the composite spring to hold a force.

2. A dragging equipment detector, comprising:

a rotatable striker shaft of a length defined between a support mount end and a composite leaf spring mount end;

the striker shaft having a plurality of striker paddles coupled thereto;

each paddle coupled to the striker shaft such that when in operation each paddle maintains a generally vertical position when at rest;

the striker shaft rotateably coupled to a support mount at the support mount end such that the striker shaft is axially rotatable;

the striker shaft rotateably coupled to a composite leaf spring at the spring mount end; and the striker shaft coupled to a sensor at either the spring mount end or the support shaft end;

wherein the composite leaf spring comprises:

a pair of spring rollers mounted to spring retainers, the spring retainers extend from the spring end of the striker shaft;

a composite spring rigidly mounted so that when the spring is at rest, the striker shaft is rotated such that the striker paddles are in a generally vertical position;

the composite leaf spring rigidly mounted such that when at least one striker paddle not in the generally vertical position the striker shaft rotates and the roller shafts and the spring rollers cause the composite spring to hold a force; and a composite leaf spring housing, the spring housing comprising:

a striker shaft bushing;

a housing interior, the housing interior having opposing composite leaf spring retainer mounts on which the spring retainer is mounted; and a housing for environmentally sealing the spring housing.

* * * * *